US005664026A

United States Patent [19]

Neri et al.

[11] Patent Number: 5,664,026

[45] Date of Patent: Sep. 2, 1997

[54] PRODUCT OPTICAL CONTROL METHOD

[75] Inventors: Armando Neri; Giancarlo Fusari; Gaetano De Pietra, all of Bologna, Italy

[73] Assignee: G.D Societa' Per Azioni, Bologna, Italy

[21] Appl. No.: 418,654

[22] Filed: Apr. 10, 1995

[30] Foreign Application Priority Data

Apr. 12, 1994 [IT] Italy ..... BO94A0153

[51] Int. Cl.[6] ..... G06K 9/00

[52] U.S. Cl. ..... 382/143; 209/536

[58] Field of Search ..... 382/100, 108, 382/111, 112, 143, 135; 348/88, 91; 356/237; 209/535, 536

[56] References Cited

U.S. PATENT DOCUMENTS

| | | | |
|---|---|---|---|
| 3,035,380 | 5/1962 | Leavens | 53/47 |
| 3,898,617 | 8/1975 | Kashioka et al. | 382/151 |
| 4,053,056 | 10/1977 | Day | 209/73 |
| 4,115,762 | 9/1978 | Akiyama et al. | 382/151 |
| 4,253,112 | 2/1981 | Doemens | 382/151 |
| 4,550,433 | 10/1985 | Takahashi | 382/112 |
| 5,014,325 | 5/1991 | Moritomo | 382/135 |
| 5,040,228 | 8/1991 | Bose et al. | 382/141 |
| 5,058,175 | 10/1991 | Aso | 382/112 |
| 5,121,438 | 6/1992 | Kawauchi et al. | 382/141 |
| 5,125,037 | 6/1992 | Lehtonen et al. | 382/112 |
| 5,295,196 | 3/1994 | Raterman et al. | 382/7 |
| 5,365,596 | 11/1994 | Dante et al. | 382/141 |
| 5,367,577 | 11/1994 | Gotaas | 382/135 |

*Primary Examiner*—Joseph Mancuso
*Assistant Examiner*—Gerard Del Rosso
*Attorney, Agent, or Firm*—Ladas & Parry

[57] ABSTRACT

A method of optically controlling products consisting, for example, of blanks whereby a succession of blanks fed along a conveyor to a user machine is controlled by an analog sensor for scanning the surface of each blank along a given line, and developing a signal curve as a function of the different graphic characteristics detected along the line; a comparing device compares the signal curve with a reference curve, and emits an error signal in the event the blanks are not the right type and/or are not oriented and/or positioned correctly.

10 Claims, 2 Drawing Sheets

PRODUCT OPTICAL CONTROL METHOD

BACKGROUND OF THE INVENTION

The present invention relates to a product optical control method.

Here and hereinafter, the term "control" is intended to mean control for determining whether products—consisting for example of cardboard blanks—are of the right type and/or are oriented correctly and/or face the right way and/or are positioned correctly.

The present invention is particularly advantageous for controlling blanks supplied successively to a user machine in the tobacco industry, such as a cigarette packing machine, to which the following description refers purely by way of example.

The blanks fed along the conveyor of a cigarette packing machine are known to be controlled using a fixed digital sensor for detecting the passage, at a given instant, of a given graphic mark on the surface of each blank.

In the event the blank is not the right type, or is upside down, faces the wrong way, or is simply positioned wrongly, the digital sensor, on failing to detect the passage of the graphic mark at the predetermined instant, emits an error signal to arrest the packing machine.

The above method involves a particularly painstaking process for correctly positioning the digital sensor in relation to the blanks. Indeed, since the digital sensor provides solely for emitting a YES-NO signal in response to detection, or not, of a graphic mark in a predetermined location at a predetermined instant, the sensor must be positioned extremely accurately in relation to the path of the blanks, to prevent even small and substantially acceptable inaccuracies in the positioning of the blanks from resulting in stoppage of the machine.

SUMMARY OF THE INVENTION

It is an object of the present invention to provide a method of controlling blanks, designed to overcome the aforementioned drawback.

According to the present invention, there is provided a method of optically controlling products of a given type; the method comprising the steps of feeding the products in an orderly succession along a given path in a given traveling direction and through a detecting station; detecting graphic characteristics of each product at the detecting station, to obtain a detection signal as a function of the characteristics detected; and comparing the detection signal with a reference signal relative to the type of product being controlled, for emitting, if necessary, an error signal; characterized in that the detecting step comprises the steps of surface scanning each product along a given scan line; and developing a signal curve as a function of different graphic characteristics detected along the scan line; said reference signal consisting of a reference curve.

According to a preferred embodiment of the above method, said scan is performed by means of an analog detecting device, and preferably along a line parallel to said traveling direction.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
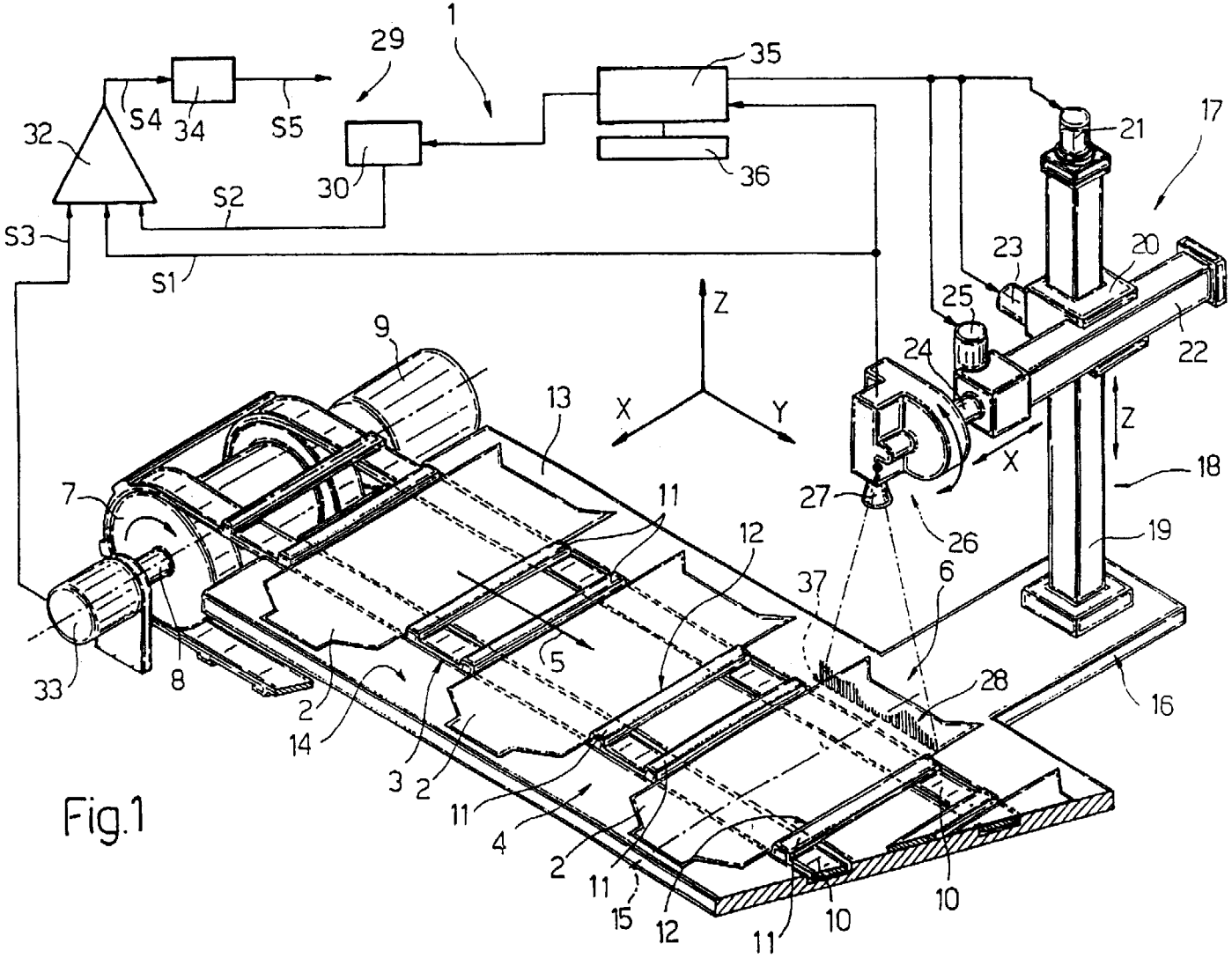
FIG. 1 shows a schematic view in perspective of a blank control unit implementing the method according to the present invention.

Numeral 1 in FIG. 1 indicates an optical control unit for controlling products consisting for example of blanks 2 for supply to the input (not shown) of a cigarette packing machine (not shown).

In the following description, reference is made purely by way of example to controlled products consisting of blanks of the type described.

Unit 1 comprises a conveyor belt 3—for example, of the type described in British Patent n. 1,571,465— for feeding an orderly succession of blanks 2 along a path 4 in direction 5 and through a detecting station 6.

Conveyor 3 comprises a pair of pulleys 7 (only one shown in FIG. 1), one of which is fitted to a shaft 8 connected to a motor 9 for rotating shaft 8 and corresponding pulley 7 clockwise in FIG. 1. Conveyor 3 also comprises at least two endless belts 10 connected to each other by a number of cross members 11, each two of which define a pocket 12 for receiving a blank 2. Cross members 11 are mounted so as to slide along a fixed plate 13 defining a conveyor surface 14 for blanks 2.

In an XYZ cartesian reference system, surface 14 extends parallel to the XY plane, direction 5 is parallel to the Y axis, and each blank 2 is housed inside a respective pocket 12 with its longitudinal axis 15 parallel to the X axis.

At station 6, plate 13 presents a lateral appendix 16 projecting from plate 13 in a direction parallel to the X axis, and supporting a detecting device 17 comprising a three-axis machine 18. Machine 18 in turn comprises a fixed upright 19 supported parallel to the Z axis on appendix 16 and in turn supporting a slide 20 movable along upright 19 by a motor 21. Slide 20 supports an arm 22 extending parallel to the X axis, slidable axially in relation to slide 20 by a motor 23, and the end of which facing conveyor 3 is fitted with a shaft 24 coaxial with arm 22 and rotated about its axis in relation to arm 22 by means of a motor 25. Shaft 24 is fitted with a detecting head 26 located over path 4 and comprising an analog photocell 27 orientable in the YZ plane by motor 25, and which, for each blank 2 traveling through station 6, emits a signal S1 consisting of a detection curve 28.

Unit 1 also comprises a control circuit 29 in turn comprising an emitting device 30 for emitting a reference signal S2 consisting of a reference curve 31, and a comparing device 32 presenting two inputs for receiving signals S1 and S2. Comparing device 32 provides for comparing signals S1 and S2 on the basis of a synchronizing signal S3 emitted by an encoder 33 connected to shaft 8, and for supplying an error signal S4, defined by the difference between signals S1 and S2, to a threshold circuit 34 for emitting a digital YES-NO signal S5.

Circuit 29 also comprises a processor 35 presenting a keyboard 36, and which provides, firstly, for controlling motors 21, 23, 25; secondly, for controlling emitting device 30 relative to the signal S2 to be emitted; and, thirdly, for receiving signal S1 from photocell 27. More specifically, processor 35 provides for memorizing the signals S2 relative to a given number of different blanks 2, together with associated data (position of photocell 27 in the XZ plane and about the X axis) relative to each signal S2.

Operation of unit 1 will now be described relative to the case in which blanks 2 unknown to processor 35 are to be fed along conveyor 3. In this case, actual control is preceded by an automatic learning procedure wherein a blank 2 of the type to be used is positioned correctly inside a respective pocket 12 and fed to station 6. At the same time, a particularly significant line 37 on blank 2 is selected along which to perform the scanning operation by means of detecting device 17, and motors 21, 23, 25 are operated to position analog photocell 27 directly over the selected line 37 and with the required orientation about the axis of shaft 24. At this point, blank 2 is fed through station 6 to scan the selected line 37 and obtain a detection curve 28 which is memorized by processor 35 together with associated data comprising data relative to the position of head 26 during detection, and data, supplied by encoder 33, relative to the position assumed at each instant by blank 2 during detection; which curve 28 is then used as reference signal S2 during actual control.

In the event blank 2 to be controlled is of a type already known to processor 35, i.e. in the event the reference signal relative to the blank has already been memorized by the processor together with the relative associated data, the above automatic learning procedure is naturally skipped, and the blank type is simply entered on keyboard 36 to accurately instruct emitting device 30 and machine 18 concerning the type of reference signal to be emitted and the position of head 26 respectively.

Figure 2:
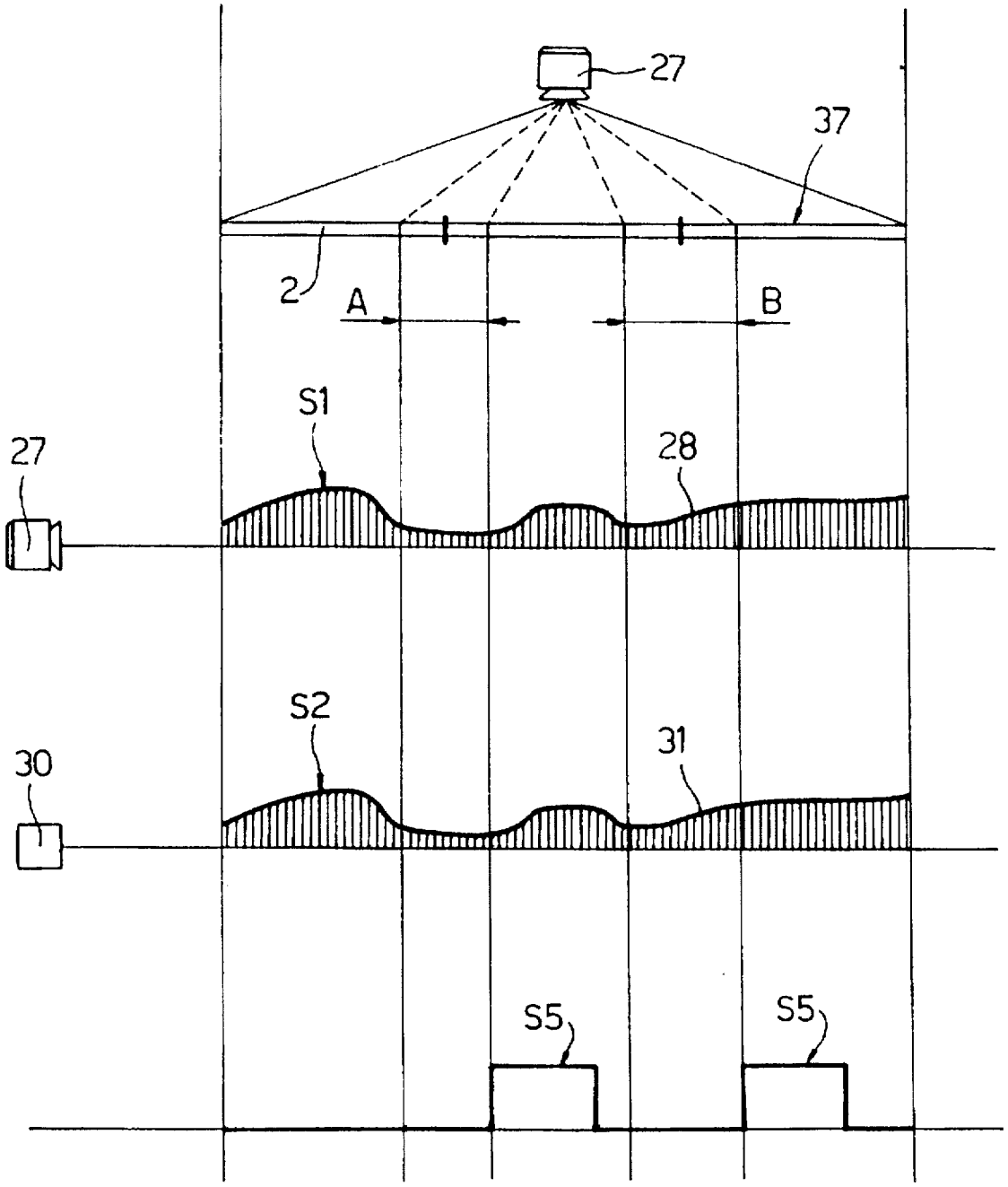
FIG. 2 shows operating graphs relative to the method according to the present invention.

As shown in FIG. 2, during actual control, analog photocell 27 emits a signal S1 consisting of a given detection curve 28, while emitting device 30 supplies, in time with photocell 27, a reference signal S2 consisting of a given reference curve 31. As shown in the FIG. 2 example, only particularly indicative portions—in this case, portions A and B—of curves 28 and 31 are normally compared by device 32; which portions A and B may of course involve any portion (or even the whole) of curves 28 and 31.

A change in the type of blank used therefore poses no difficulty in that, in most cases, the new blank type is simply entered on keyboard 36 to automatically obtain both the correct position of head 26 and the type of reference signal to be used.

The above method of determining the type, orientation and position of blanks 2 may also be used for similarly controlling any type of product consisting, for example, of packets or cartons presenting portions of different colors.

We claim:

1. A method of optically controlling products of a given type; the method comprising feeding products of said given type by a conveyor means in an orderly succession along a given path in a given traveling direction and through a detecting station; controlling the conveyor means by an encoder means to obtain a synchronizing signal; surface scanning each product along a selected scan line on each product; producing a detection signal, consisting of a signal curve, as a function of different graphic characteristics detected along the scan line; providing a reference signal consisting of a reference curve related to the product being controlled; comparing the detection signal with the reference signal under the control of the synchronizing signal for emitting an error signal; and supplying the error signal to a threshold circuit for emitting a YES-NO signal for selectively stopping said conveyor means when the error signal exceeds a threshold value by a predetermined amount and wherein said products are foldable blanks which are placed flat on said conveyor means and on each of which blanks said scan line is placed to extend in the traveling direction of the convevor means.

2. A method as claimed in claim 1, wherein said scan is performed by means of an analog detecting device.

3. A method as claimed in claim 2, further comprising a preliminary step in turn comprising the substeps of memorizing a number of reference curves relative to a corresponding number of different product types, each reference curve being memorized together with a number of associated data relative to the position of said scan line on the relative product; selecting, from the curves in said number of reference curves, the reference curve relative to the product type to be controlled; and adjusting the position of said analog detecting device in relation to said path on the basis of the associated data relative to the selected reference curve.

4. A method as claimed in claim 1, further comprising the step of obtaining, by means of an automatic learning procedure, a signal curve for a given product type, together with a number of associated data relative to the position of said scan line; memorizing said signal curve and the relative associated data; and using said memorized signal curve as the reference signal for controlling the products of said given type.

5. A method as claimed in claim 1, wherein said blanks are supplied to the input of a packing machine.

6. A method as claimed in claim 1, comprising placing said blanks in pockets formed on said conveyor means.

7. A method as claimed in claim 1, said threshold circuit effecting comparison of said error signal to said threshold value and emitting said signal for stopping said conveyor means when a difference between said error signal and said threshold value exceeds said predetermined amount whereas when said difference is less than said predetermined amount said conveyor means continues to operate and advance said blanks.

8. A method as claimed in claim 1, said synchronizing signal selecting portions of the detection signal curve and the reference signal curve to be compared.

9. A method as claimed in claim 3, wherein the position of the analog detection device, after adjustment thereof based on the selected reference curve, remains fixed while producing the detection signals for the products corresponding to the selected reference curve.

10. A method as claimed in claim 9, comprising mechanically shifting the analog detection device to adjust the position thereof for different reference curves.

* * * * *